US011349244B2

(12) United States Patent
Hsu

(10) Patent No.: US 11,349,244 B2
(45) Date of Patent: May 31, 2022

(54) ELECTRICAL CONTACT

(71) Applicants: FOXCONN (KUNSHAN) COMPUTER CONNECTOR CO., LTD., Kunshan (CN); FOXCONN INTERCONNECT TECHNOLOGY LIMITED, Grand Cayman (KY)

(72) Inventor: Shuo-Hsiu Hsu, New Taipei (TW)

(73) Assignees: FOXCONN (KUNSHAN) COMPUTER CONNECTOR CO., LTD., Kunshan (CN); FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 17/134,541

(22) Filed: Dec. 28, 2020

(65) Prior Publication Data

US 2021/0203098 A1 Jul. 1, 2021

(30) Foreign Application Priority Data

Dec. 26, 2019 (CN) ..... 201922386971.5

(51) Int. Cl.
*H01R 13/24* (2006.01)
*H01R 12/71* (2011.01)
*H01R 12/70* (2011.01)

(52) U.S. Cl.
CPC ..... *H01R 13/2407* (2013.01); *H01R 12/7082* (2013.01); *H01R 12/712* (2013.01); *H01R 13/2435* (2013.01); *H01R 13/2464* (2013.01)

(58) Field of Classification Search
CPC ..... H01R 13/2407; H01R 13/2464; H01R 12/712; H01R 12/7082; H01R 12/714; H01R 12/7076; H01R 13/2435
See application file for complete search history.

(56) References Cited

U.S. PATENT DOCUMENTS 5,437,556 A * 8/1995 Bargain ..... H01R 13/2435 439/66
6,019,611 A * 2/2000 McHugh ..... H01R 13/2435 439/515
6,913,469 B2 * 7/2005 Chiang ..... H01R 13/2435 439/66

(Continued)

FOREIGN PATENT DOCUMENTS

CN 107968272 B 8/2019

*Primary Examiner* — Travis S Chambers
(74) *Attorney, Agent, or Firm* — Ming Chieh Chang; Wei Te Chung

(57) ABSTRACT

An electrical contact includes a retention section of an outer part and an extension section of an inner part parallel to each other and linked to each other via a transverse bridge located in another vertical plane perpendicular to both the retention section and the extension section. An upper contacting arm extends, toward the extension section, from an upper end of the retention section with an upper mating apex and an upper abutment tip region, and a lower contacting arm extends, toward the extension, from a lower end of the retention section with a lower mating apex and a lower abutment tip region. An upper abutment tab upwardly and obliquely extends from an upper end of the extension section toward the retention section and adapted to be mated with the upper abutment tip region when the upper contacting arm is downwardly depressed by the CPU.

17 Claims, 6 Drawing Sheets

(56) References Cited

U.S. PATENT DOCUMENTS

| | | | | |
|---|---|---|---|---|
| 6,957,964 | B2 * | 10/2005 | Chiang | H01R 13/2435 439/66 |
| 7,160,115 | B2 | 1/2007 | Huang et al. | |
| 7,527,536 | B2 * | 5/2009 | Chiang | H01R 13/2442 439/884 |
| 8,672,688 | B2 * | 3/2014 | Florence, Jr. | H01R 12/52 439/66 |
| 9,425,525 | B2 | 8/2016 | Amphenol | |
| 9,882,296 | B1 * | 1/2018 | Ju | H01R 13/432 |
| D830,305 | S * | 10/2018 | Lin | D13/133 |
| 10,199,756 | B2 | 2/2019 | Lotes | |
| 10,535,946 | B2 | 1/2020 | Lotes | |
| 2018/0198219 | A1 * | 7/2018 | Ju | H05K 7/1061 |
| 2020/0328550 | A1 | 10/2020 | Lotes | |

* cited by examiner

ELECTRICAL CONTACT

BACKGROUND OF THE INVENTION

1. Field of the Invention

The present invention relates to an electrical contact for use within an electrical connector, and particularly to the contact having multiple transmission paths.

2. Description of Related Arts

U.S. Pat. No. 9,882,296 discloses the contact having the retaining section located in a middle vertical plane, a pair of outer contacting arms extending from an outer vertical plane, and a pair of inner contacting arms extending from an inner vertical plane, wherein the outer vertical plane and the inner vertical plane are parallel to each other and both are perpendicular to the middle vertical plane, and the outer contacting arms are deflected to contact the corresponding inner contacting arms, respectively, during operation. On one hand, because the inner contacting arm extends along the same direction with the outer contacting arm, it takes more space, thus hindering miniaturization of the connector design; on the other hand, because the middle vertical plane is essentially immovable, the inner contacting arm may be relatively rigid when shortening the inner contacting arm for miniaturization, thus being unwelcome for coupling between the outer contacting arm and the inner contacting arm.

Therefore, it is desired to provide an electrical contact with a shortened dimension of the inner contacting arm along the extending direction of the outer contacting arm while still maintaining the desired resiliency of the inner contacting arm thereof for proper coupling between the outer contacting arm and the inner contacting arm.

SUMMARY OF THE INVENTION

To achieve the above object, an electrical contact for connecting a CPU (Central Processing Unit) and a PCB (Printed Circuit Board), includes a retention section of an outer part and an extension section of an inner part parallel to each other and linked to each other via a transverse bridge located in another vertical plane perpendicular to both the retention section and the extension section. An upper contacting arm extends, toward the extension section, from an upper end of the retention section with an upper mating apex and an upper abutment tip region, and a lower contacting arm extends, toward the extension, from a lower end of the retention section with a lower mating apex and a lower abutment tip region. An upper abutment tab upwardly and obliquely extends from an upper end of the extension section toward the retention section and adapted to be coupled with the upper abutment tip region when the upper contacting arm is downwardly depressed by the CPU, and a lower abutment tab downwardly and obliquely extends from the lower end of the extension section toward the retention section and adapted to be coupled with the lower abutment tip region when the lower contacting arm is upwardly depressed by the PCB. Because the abutment tab of the inner part extends toward the outer part, thus minimizing the dimension of the contact along the extending direction of the contacting arm. Because the bridge may provide the inner part with more resiliency, the coupling between the abutment tip region of the outer part and the abutment tab of the inner part may be properly implemented.

Other advantages and novel features of the invention will become more apparent from the following detailed description of the present embodiment when taken in conjunction with the accompanying drawings.

DETAILED DESCRIPTION OF THE PREFERRED EMBODIMENT

Figure 1:
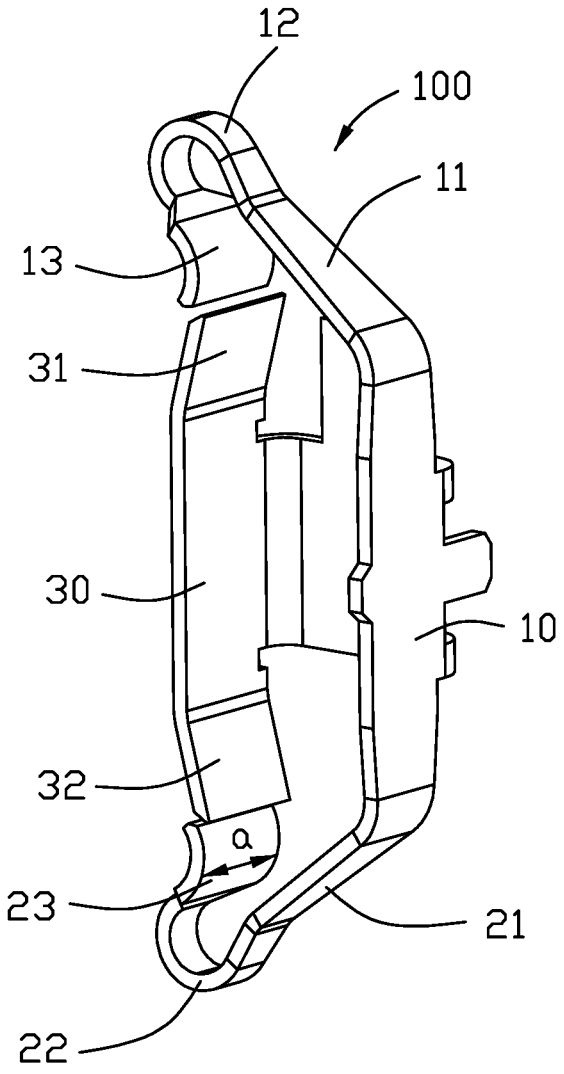
FIG. 1 is a perspective view of an electrical contact according to a first embodiment of the invention.
Figure 2:
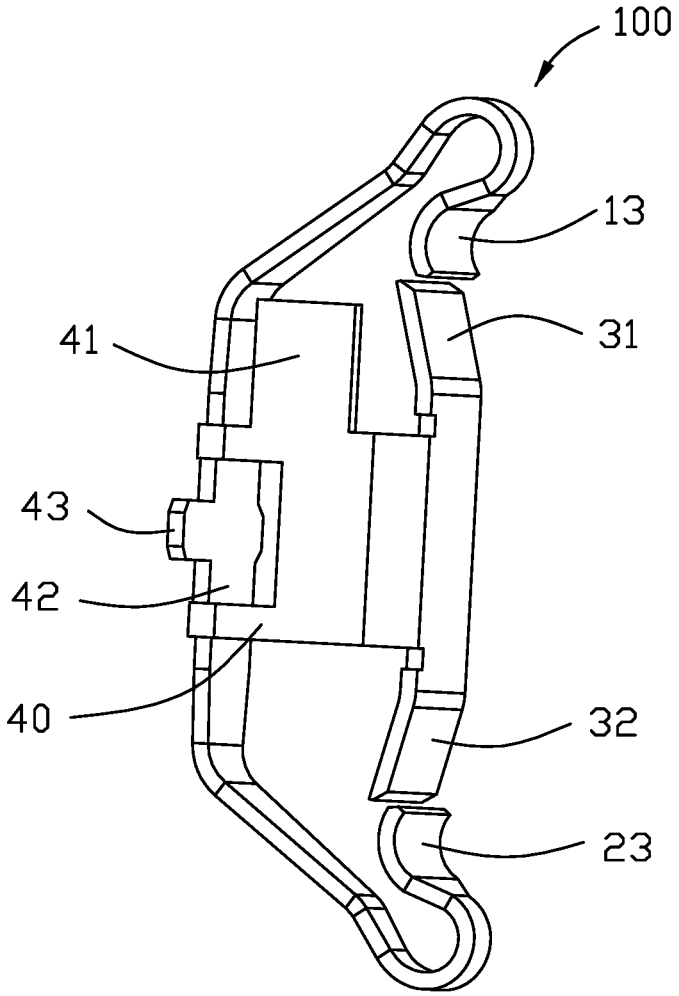
FIG. 2 is another perspective view of the electrical contact of FIG. 1.
Figure 3:
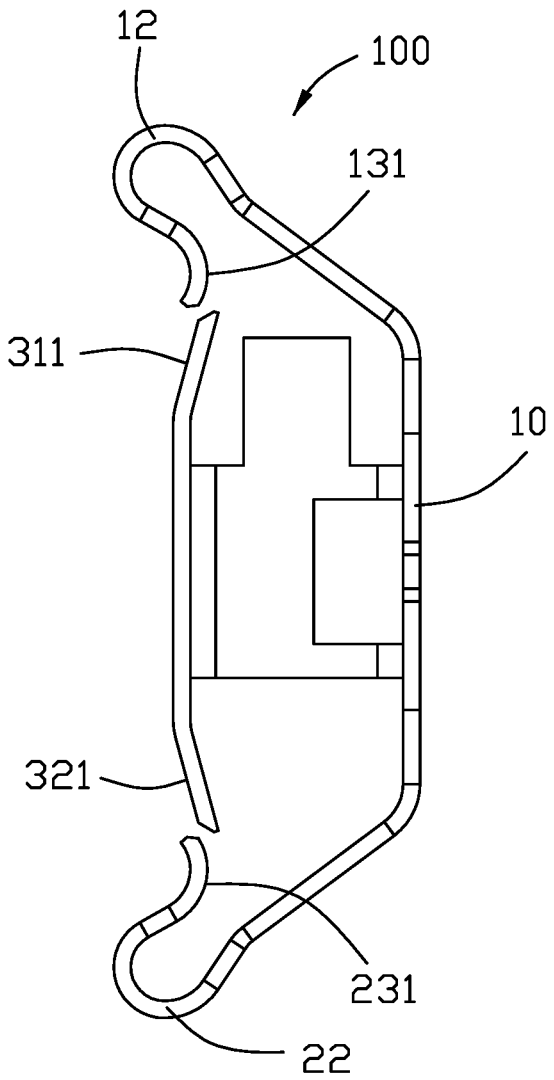
FIG. 3 is a sideview of the contact of FIG. 1.

Referring to FIGS. 1-3, an electrical contact 100 includes an outer part and inner part linked by a bridge. The outer part includes a retention section 10 and the inner part includes an extension section 30 linked transversely with the retention section 10 via the bridge or connection section 40. A resilient upper contacting arm 11 extends from an upper end of the retention section 10 toward the extension section 30 with an upper mating apex 12 and an upper abutment tip region 13 which downwardly extends from the upper mating apex 12 toward the extension section 30. Symmetrically, a resilient lower contacting arm 21 extends from a lower end of retention section 10 toward the extension section 30 with a lower mating apex 22 and a lower abutment 23 tip region which upwardly extends from the lower mating apex 22 toward the extension section 30. Correspondingly, an upper abutment tab 31 extends upwardly and obliquely from the upper end of the extension section 30 toward the retention section 10 for coupling with the upper abutment tip region 13, and a lower abutment tab 32 extends upwardly and obliquely toward the retention section 10 for coupling with the lower abutment tip region 23.

When the upper mating apex 12 is spaced from the CPU and the lower mating apex 22 is spaced from the PCB, the upper abutment tip region 13 is spaced from the upper abutment tab 31 and the lower abutment tip region 23 is spaced from the lower abutment tab 32. When the connector is sandwiched between the CPU and the PCB, the upper mating apex is downwardly depressed by the CPU to have the upper abutment tip region 13 downwardly abut against the upper abutment tab 31, and the lower mating apex is upwardly depressed by the PCB to have the lower abutment tip region 23 upwardly abut against the lower abutment tab 32.

Because the upper abutment tip region 13 forms a curved configuration 131 and the upper abutment tab 31 forms a tapered structure 311, the coupling between the upper abutment tip region 13 and the upper abutment tab 31 is essentially guidable and smooth. Similarly, the lower abutment tip region 23 forms a curved configuration 231 and the lower abutment tab 32 forms a tapered structure 321 to facilitate coupling therebetween. Understandably, coupling between the abutment tip region 13, 23 and the abutment tab 31, 32 may provide not only additional resistance force mechanically but also additional transmission path electrically for the contact when the contact is sandwiched between the CPU and the PCB. Notably, the abutment tab 31, 32 extends toward the retention section 10 may keep the minimized dimension of the whole contact structure in the extending direction of the contacting arm 11, 21. Moreover, the bridge 40 may provide the inner part, i.e., the extension section 30 and the associated abutment tab 31, 32, with more resiliency. This is the reason why the abutment tab 31, 32 of the inner part may be allowed to be relatively short, compared with the traditional spring arm design disclosed in the aforementioned U.S. Pat. No. 9,882,296. In this embodiment, the retention section 10 and the extension section 30 are respectively located in two vertical planes parallel to each other while the bridge 40 is located in another vertical plane perpendicular to both the retention section 10 and the extension section 30. The retention section 10 includes a retaining tab 43 in a coplanar manner for retaining the whole contact 100 in the connector housing (not shown). The bridge 40 includes an upward protrusion 41 for linking to the contact carrier (not shown) for assembling the contact into the connector housing (not shown). The bridge 40 further forms an opening corresponding to the retaining tab 43.

Figure 4:
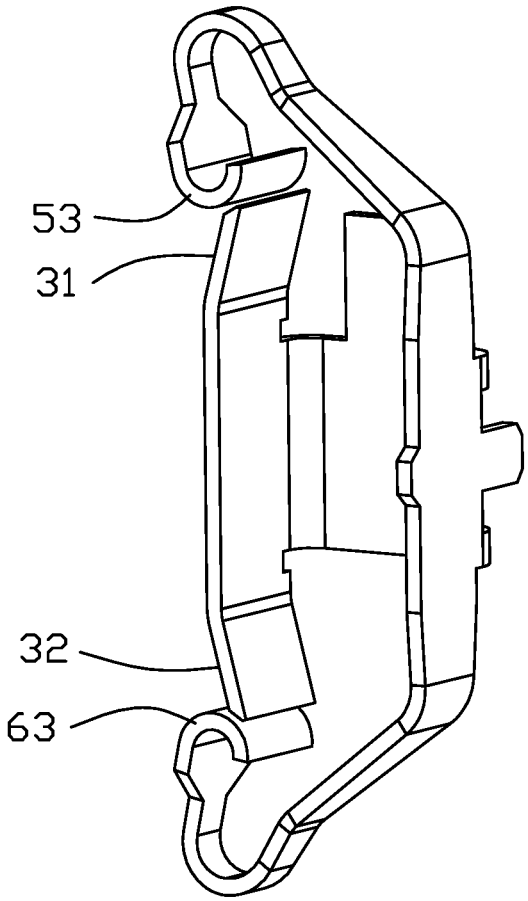
FIG. 4 is a perspective view of the contact of a second embodiment of the invention.
Figure 5:
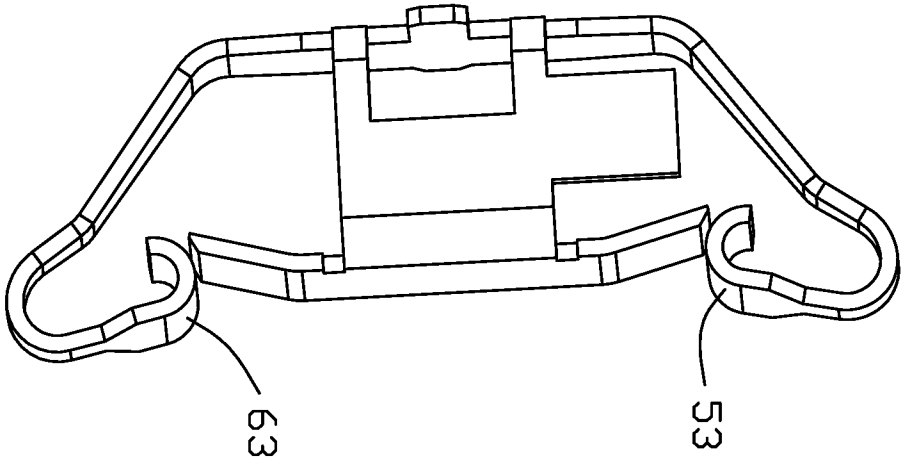
FIG. 5 is another perspective view of the contact of FIG. 4.
Figure 6:
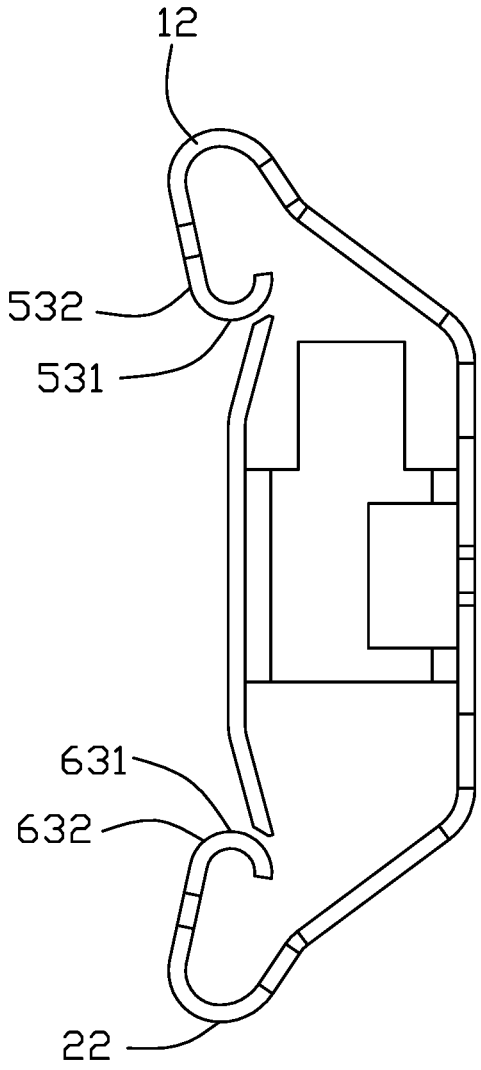
FIG. 6 is a side view of the contact of FIG. 4.

Referring to FIGS. 4-6, the contact of the second embodiment is essentially similar to that disclosed in the first embodiment of FIGS. 1-3 except the upper abutment tip region 53 and the lower abutment tip region 63. The upper abutment tip region 53 includes an inward portion 531 for coupling with the abutment tab 31, and an outward portion 532 linked between the inward portion 531 and the upper mating apex 12 to have the upper abutment tip region 53 itself forms a folded configuration. Similarly, the lower abutment tip region 63 includes an inward portion 631 and an outward portion 632 in a folded manner.

In both the embodiments, the abutment tip region and the corresponding abutment tab are not coupled with each other when the contacting arm is not mated with either the CPU or the PCB. Alternately, the coupling may occur before the contact is mated with either the CPU or the PCB to have the contacting arm in a preloaded manner. The abutment tip region 13, 23 defines an outward spoon configuration while the abutment tip region 53, 63 defines an inward spoon configuration differently.

Although the present invention has been described with reference to particular embodiments, it is not to be construed as being limited thereto. Various alterations and modifications can be made to the embodiments without in any way departing from the scope or spirit of the present invention as defined in the appended claims.

What is claimed is:

1. A metallic contact for use within an electrical connector, comprising:

a retention section and an extension section being parallel to each other while being transversely linked with each other via a bridge which is perpendicular to both the retention section and the extension section;

a resilient upper contacting arm extending from an upper end of the retention section toward the extension section, the upper contacting arm equipped with an upper mating apex for mating with a CPU (Central Processing Unit) and an upper abutment tip region downwardly extending from the upper mating apex; and an abutment tab upwardly and obliquely extending from an upper end of the extension section toward the retention section and adapted to abut against the upper abutment tip region of the upper contacting arm when the upper contacting arm is downwardly depressed by the CPU.

2. The metallic contact as claimed in claim 1, wherein the upper abutment tip region defines a curved structure while the upper abutment tab extends in a straight manner.

3. The metallic contact as claimed in claim 1, wherein the upper abutment tip region defines an outward spoon configuration.

4. The metallic contact as claimed in claim 1, wherein the upper abutment tip region defines an inward spoon configuration.

5. The metallic contact as claimed in claim 1, wherein the retention section is immoveable in the connector while both the bridge and the extension section are movable in the connector.

6. The metallic contact as claimed in claim 1, wherein the bridge forms an opening, and the retention section includes a retaining tab corresponding to the opening for retaining the contact in the connector.

7. The metallic contact as claimed in claim 6, wherein the bridge includes an upward protrusion adapted to be linked to a contact carrier.

8. The metallic contact as claimed in claim 1, further including a resilient lower contacting arm extending upwardly from a lower end of the retention section toward the extension section with a lower mating apex and a lower abutment tip region to abut against a lower abutment tab extending from a lower end of the extension section toward the retention section.

9. The metallic contact as claimed in claim 8, wherein the upper contacting arm and the lower contacting arm are symmetrical with each other, and the upper abutment tab and the lower abutment tab are symmetrical with each other.

10. A metallic contact for use within an electrical connector, comprising:

an inner part and an outer part spaced from each other while being transversely linked with each other via a bridge, the outer part including a retention section with an upper contacting arm extending from an upper end thereof, and a lower contacting arm extending from a lower end thereof symmetrically; and the inner part including an extension section transversely linked with the retention section via said bridge; wherein the upper contacting arm defines an upper mating apex with an upper abutment tip region extending downwardly therefrom to abut against an upper end of the extension section, and the lower contacting arm defines a lower mating apex with a lower abutment tip region extending upwardly therefrom to abut against a lower end of the extension section;

the upper abutment tip region forms a curved structure while the upper end of the extension section forms an obliquely extending abutment tab in a straight manner; and the abutment tab extends toward the retention section.

11. The metallic contact as claimed in claim 10, wherein the curved structure is essentially an inward spoon configuration in a folded manner.

12. The metallic contact as claimed in claim 10, wherein the curved structure is essentially an outward spoon configuration facing away from the retention section.

13. The metallic contact as claimed in claim 10, wherein the retention section includes a retaining tab extending coplanar with the retention section for engagement within the connector.

14. The metallic contact as claimed in claim 13, wherein the bridge forms an opening corresponding to the retaining tab.

15. The metallic contact as claimed in claim 14, wherein the bridge further includes an upward protrusion configured to be linked with a contact carrier for assembling the contact into the connector.

16. A metallic contact for use within an electrical connector, comprising:

an inner part and an outer part spaced from each other while being transversely linked with each other via a bridge;

the outer part including a retention section with an upper contacting arm extending from an upper end thereof, and a lower contacting arm extending from a lower end thereof symmetrically; and the inner part including an extension section transversely linked with the retention section via said bridge; wherein the upper contacting arm defines an upper mating apex with an upper abutment tip region extending downwardly therefrom to abut against an upper end of the extension section, and the lower contacting arm defines a lower mating apex with a lower abutment tip region extending upwardly therefrom to abut against a lower end of the extension section;

the upper abutment tip region forms a curved structure while the upper end of the extension section forms an obliquely extending abutment tab in a straight manner; and the curved structure is essentially an outward spoon configuration facing away from the retention section.

17. A metallic contact for use within an electrical connector, comprising:

an inner part and an outer part spaced from each other while being transversely linked with each other via a bridge;

the outer part including a retention section with an upper contacting arm extending from an upper end thereof, and a lower contacting arm extending from a lower end thereof symmetrically; and the inner part including an extension section transversely linked with the retention section via said bridge; wherein the upper contacting arm defines an upper mating apex with an upper abutment tip region extending downwardly therefrom to abut against an upper end of the extension section, and the lower contacting arm defines a lower mating apex with a lower abutment tip region extending upwardly therefrom to abut against a lower end of the extension section;

the upper abutment tip region forms a curved structure while the upper end of the extension section forms an obliquely extending abutment tab in a straight manner;

the retention section includes a retaining tab extending coplanar with the retention section for engagement within the connector; and the bridge forms an opening corresponding to the retaining tab.

* * * * *